US006327539B1

(12) United States Patent
Keultjes et al.

(10) Patent No.: US 6,327,539 B1
(45) Date of Patent: Dec. 4, 2001

(54) METHOD OF DETERMINING DRILL STRING STIFFNESS

(75) Inventors: Wouter Johannes Gregorius Keultjes; Leon Van Den Steen, both of Gd Rijswijk (NL)

(73) Assignee: Shell Oil Company, Houston, TX (US)

( * ) Notice: Subject to any disclaimer, the term of this patent is extended or adjusted under 35 U.S.C. 154(b) by 0 days.

(21) Appl. No.: 09/383,087

(22) Filed: Aug. 25, 1999

(30) Foreign Application Priority Data

Sep. 9, 1998 (EP) ..... 98307277

(51) Int. Cl.[7] ..... G01C 1/00; E21B 44/00; E21B 12/02

(52) U.S. Cl. ..... 702/42; 702/9; 702/145; 73/152.43; 73/152.47; 175/40

(58) Field of Search ..... 73/862.08, 152.47, 73/152.43, 152.01, 152.03, 152.59; 175/39, 40; 702/9, 42, 145; 33/304; 166/250.01; 181/105; 173/4, 6; 340/853.1, 853.3, 853.4

(56) References Cited

U.S. PATENT DOCUMENTS 5,864,058 * 1/1999 Chen ..... 73/152.47
6,205,851 * 3/2001 Jogi ..... 73/152.47

FOREIGN PATENT DOCUMENTS 443689 8/1991 (EP) .
816629 1/1998 (EP) .
0443689 A2 * 8/1991 (EP) ..... E21B/41/00
2705801 12/1994 (FR) .
2311140 9/1997 (GB) .

* cited by examiner

*Primary Examiner*—Patrick Assouad
*Assistant Examiner*—Paul Kim

(57) ABSTRACT

A method is provided for determining the rotational stiffness of a drill string for drilling of a borehole in an earth formation, the drill string having a bottom hole assembly (BHA) and an upper end driven by a rotational drive system. The method comprises the steps of determining the time derivative of the drill string torque during drilling of the borehole at a selected time when stick-slip of the BHA occurs, determining the nominal rotational speed of the drill string at an upper part thereof and at said selected time, and determining the rotational stiffness of the drill string from a selected relationship between said time derivative of the drill string torque and said nominal rotational speed at the upper part of the drill string.

9 Claims, 1 Drawing Sheet

METHOD OF DETERMINING DRILL STRING STIFFNESS

FIELD OF THE INVENTION

The present invention relates to a method and system for determining the rotational stiffness of a drill string for drilling a borehole into an earth formation.

BACKGROUND OF THE INVENTION

During rotary drilling the drill string, and in particular the lower part thereof which is termed the bottom hole assembly (BHA), can be subjected to undesired rotational vibrations also referred to as oscillations. The magnitude and frequency of such rotational vibrations depend on parameters such as the length and stiffness of the drill string, the number and positions of the drill string stabilisers, the shape of the borehole, and the weight of the BHA. Stick-slip is a mode of rotational vibration which is particularly undesirable as it leads to a reduced penetration rate of the drill bit and to enhanced wear and damage to the drill string. During stick-slip the movement of the drill string is characterised by repeated cycles of deceleration and acceleration whereby in each cycle the drill bit comes to a halt and subsequently accelerates to a speed significantly higher than the nominal speed of the rotary table.

EP-A-0443689 discloses a system for controlling drill string vibrations, which varies the rotary speed gradually in response to rotational vibrations of the string so as to damp the vibrations. The drill string is driven by a drive system which in most cases includes a rotary table driven by an electric motor, or by a top drive driven by an electric motor. The control system operates on the principle of controlling the energy flow through the drive system and can be represented by a combination of a rotational spring and a rotational damper associated with the drive system. To obtain optimal damping, the spring constant of the spring and the damping constant of damper are to be tuned to optimal values. It will be understood that the rotational stiffness of the drill string plays an important role in tuning to such optimal values. However, the actual rotational stiffness of the drill string is generally unknown as it changes during the drilling process due to, for example, the drill string being extended as the borehole becomes deeper.

It is therefore an object of the invention to provide a method and a system for determining the rotational stiffness of a drill string for drilling of a borehole in an earth formation.

SUMMARY OF THE INVENTION

In accordance with the invention there is provided a method of determining the rotational stiffness of a drill string for drilling of a borehole in an earth formation, the drill string having a bottom hole assembly (BHA) and an upper end driven by a rotational drive system, the method comprising the steps of:

- determining the time derivative of the drill string torque during drilling of the borehole at a selected time when stick-slip of the BHA occurs;
- determining the nominal rotational speed of the drill string at an upper part thereof at said selected time; and
- determining the rotational stiffness of the drill string from a selected relationship between said time derivative of the drill string torque and said nominal rotational speed at the upper part of the drill string.

DETAILED DESCRIPTION

The drill string torque is a linear function of the rotational stiffness of the drill string and the twist of the drill string. Consequently the time derivative of the drill string torque is linearly dependent on the drill string stiffness and the instantaneous speed difference between the BHA and the upper part of the drill string. During stick-slip the speed of the BHA varies between zero and a magnitude of about twice the nominal speed of the upper part of the drill string. Therefore the amplitude of the speed variation of the BHA has a magnitude of about the nominal speed of the upper part of the string. Thus, by suitably selecting the relationship between the time derivative of the torque and the nominal rotational speed at the upper part of the string, the rotational stiffness can be determined.

It was found that a sine-wave suitably fits the speed of the BHA as a function of time. Therefore, in a preferred embodiment of the method of the invention said selected relationship is:

$$\frac{dT_{ds}}{dt} = k_2 A_{cf} \Omega_{nom} \cos(\omega_0 t); \tag{1}$$

wherein $$\frac{dT_{ds}}{dt}$$

is the time derivative of the drill string torque;

$k_2$ is the drill string stiffness;

$A_{cf}$ is a correction factor;

$\Omega_{nom}$ is the nominal speed of the upper part of the drill string; and $\omega_0$ is the frequency of the drill string oscillation.

Preferably the time derivative of the drill string torque at said selected time is at a maximum so that said selected relationship is:

$$\max \frac{dT_{ds}}{dt} = k_2 A_{cf} \Omega_{nom}. \tag{2}$$

Alternatively the time derivative of the drill string torque at said selected time is at a minimum so that said selected relationship is:

$$\min \frac{dT_{ds}}{dt} = -k_2 A_{cf} \Omega_{nom}. \tag{3}$$

The system according to the invention comprises:

- means for determining the time derivative of the drill string torque during drilling of the borehole at a selected time when stick-slip of the BHA occurs;
- means for determining the nominal rotational speed of the drill string at an upper end part thereof at said selected time; and
- means for determining the rotational stiffness of the drill string from a selected relationship between said time derivative of the drill string torque and said nominal rotational speed.

In order to further improve tuning of the spring constant and the damping constant of the control system it is preferred that the actual magnitude of the rotational moment of inertia of the BHA is taken into account, which moment of inertia is determined from the rotational stiffness of the drill string using the relationship:

$$J_1=k_2\omega_0^2; \tag{4}$$

wherein $J_1$ is the rotational moment of inertia of the BHA.

The invention will be described hereinafter in more detail and by way of example.

Figure 1:
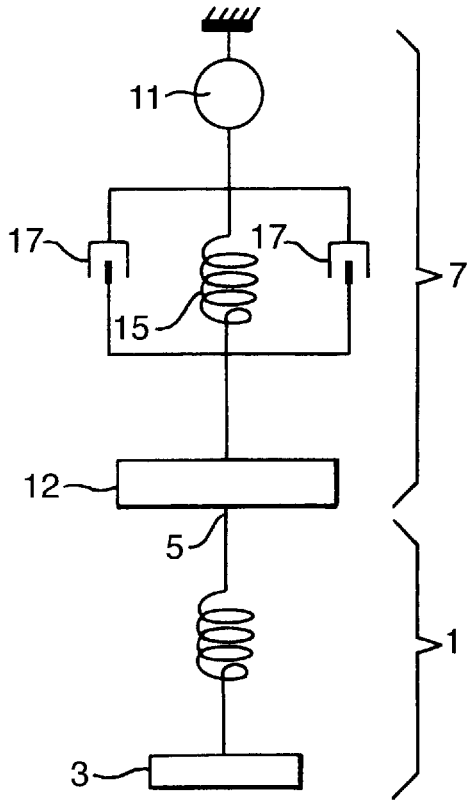
FIG. 1 schematically shows a drill string and rotational drive system used in applying the method and system of the invention.

Referring to FIG. 1 there is shown a schematic embodiment of a drill string 1 having a lower part 3 forming a bottom hole assembly (BHA) and an upper end 5 driven by a rotational drive system 7. The BHA 3 has moment of inertia $J_1$, the drill string 1 has torsion stiffness $k_2$, and the drive system 7 has moment of inertia $J_3$. In the schematic embodiment of FIG. 1 the moment of inertia of the part of the drill string between the BHA 3 and the drive system 7 has been lumped to both ends of the string, i.e. to $J_1$ and $J_3$.

The drive system 7 includes an electric motor 11 and a rotary table 12 driven by the electric motor 11, and is connected to an electronic control system (not shown) for damping rotational vibrations of the drill string 1 by absorbing rotational vibration energy thereof. The damping action of the control system is simulated by a torsion spring 15 and a rotational damper 17 located between the electric motor 11 and rotary table. The spring 15 has spring constant $k_f$ and the rotational damper 17 has damping constant $c_f$. The control system has to be tuned so as to select optimum values for the parameters $k_f$ and $c_f$, which optimal values depend on the drill string parameters $k_2$ and $J_1$. The procedure of selecting such optimum values is not an object of the present invention. Rather it is an object of the invention to determine the actual magnitudes of $k_2$ and $J_1$ in order to be able to tune the control system optimally. It will be understood that the magnitudes of $k_2$ and $J_1$ change as drilling proceeds due to, for example, the drill string being extended as the borehole is deepened, or the BHA being changed.

Figure 2:
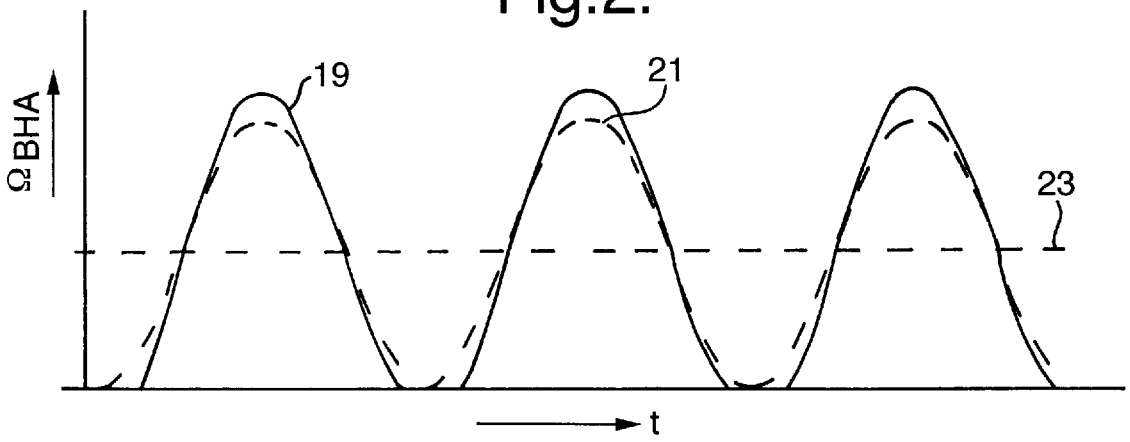
FIG. 2 schematically shows rotational velocity fluctuations of the BHA of the drill string of FIG. 1, as a function of time.

In FIG. 2 is shown a diagram in which line 19 represents the rotational speed of the BHA as a function of time during stick-slip, and line 21 represents a sine-wave approximation of the speed of the BHA. The speed of the BHA typically varies around the average speed $\Omega_{nom}$ of the rotary table 12 by an amplitude which is of the order of $\Omega_{nom}$, the average speed being indicated by line 23. The sine-wave approximation of the speed, represented by line 21, can be written as:

$$\Omega_{BHA}=\Omega_{nom}+A_{cf}\Omega_{nom}\cos(\omega_0 t) \tag{5}$$

wherein $\Omega_{BHA}$ is the approximated instantaneous speed of the BHA 3;

$A_{cf}$ is the correction factor referred to above;

$\Omega_{nom}$ is the nominal speed of the rotary table 12; and $\omega_0$ is the frequency of the drill string oscillation.

In most cases the correction factor can be selected $A_{cf}=1$. Alternatively $A_{cf}$ can be selected slightly larger than 1 to account for non-linearity of the speed of the BHA, e.g. $1.0 \leqq A_{cf} \leqq 1.2$.

Since the speed variations of the rotary table 12 are generally negligible compared to those of the BHA 3, it is reasonable to assume that the instantaneous speed difference $\Delta\Omega$ between rotary table 12 and the BHA 3 is:

$$\Delta\Omega=A_{cf}\Omega_{nom}\cos(\omega_0 t) \tag{6}$$

The torque in the drill string 1 is:

$$T_{ds}=k_2\phi_{ds} \tag{7}$$

wherein $T_{ds}$ is the drill string torque; and $\phi_{ds}$ is the drill string twist.

With $$\frac{d\phi_{ds}}{dt}=\Delta\Omega$$

it follows from eqs. (2) and (3) that:

$$\frac{dT_{ds}}{dt}=k_2\frac{d\phi_{ds}}{dt}=k_2A_{cf}\Omega_{nom}\cos(\omega_0 t) \tag{8}$$

which has a maximum of:

$$\max\frac{dT_{ds}}{dt}=k_2A_{cf}\Omega_{nom} \tag{9}$$

The equation of motion of the rotary table 12 is:

$$J_3\frac{d\Omega_r}{dt}=T_r-T_{ds} \tag{10}$$

wherein $\Omega$, is the rotating speed of the rotary table 12; and $T_r$ is the torque delivered by the motor 11 to the rotary table 12.

From the above description it follows that the rotational stiffness of the drill string 1 can be obtained through the following steps:

a) determine $\Omega_r$ and $T_r$ e.g. from the current and voltage supplied to the electric motor;

b) determine the drill string torque $T_{ds}$ from eq. (10);

c) determine the maximum of the time derivative of $T_{ds}$, i.e.

$$\frac{dT_{ds}}{dt};$$

d) determine the nominal speed of the rotary table $\Omega_{nom}$ and select a suitable value for $A_{cf}$ (e.g. =1); and e) determine $k_2$ using eq. (9), i.e.

$$k_2=\max\frac{dT_{ds}}{dt}=A_{cf}\Omega_{nom} \tag{11}$$

Furthermore, in the majority of cases the frequency of drill string oscillation is of the order of the natural frequency of the drill string, therefore $\Omega_0$ can be approximated by:

$$\omega_0=\sqrt{k_2/J_1} \tag{12}$$

The moment of inertia of the BHA 3 can now be determined by measuring the frequency of oscillation $\omega_0$, and from eqs. (11) and (12):

$$J_1=k_2/\omega_0^2 \tag{13}$$

The control system can now be tuned in dependence on the values of the parameters $k_2$ and $J_1$.

If necessary the accuracy of the above procedure can be enhanced by determining any harmonics in the signal representing the drill string oscillation and taking such harmonics into account in the above equations.

We claim:

1. A method of determining the rotational stiffness of a drill string for drilling of a borehole in an earth formation, the drill string having a bottom hole assembly (BHA) and an upper end driven by a rotational drive system, the method comprising the steps of:

determining the time derivative of the drill string torque during drilling of the borehole at a selected time when stick-slip of the BHA occurs;

determining the nominal rotational speed of the drill string at an upper part thereof at said selected time; and determining the rotational stiffness of the drill string from a selected relationship between said time derivative of the drill string torque and said nominal rotational speed at the upper part of the drill string.

2. The method of claim 1, wherein said selected relationship $$\frac{dT_{ds}}{dt} = k_2 A_{cf} \Omega_{nom} \cos(\omega_0 t);$$

wherein $$\frac{dT_{ds}}{dt}$$

is the time derivative of the drill string torque, $k_2$ is the drill string stiffness, $A_{cf}$ is a correction factor, $\Omega_{nom}$ is the nominal speed of the upper part of the drill string, and $\omega_0$ is the frequency of the drill string oscillation.

3. The method of claim 2, wherein at said selected time the time derivative of the drill string torque is at a maximum, and said selected relationship is $$\max\frac{dT_{ds}}{dt} = k_2 A_{cf} \Omega_{nom}.$$

4. The method of claim 2, wherein at said selected time the time derivative of the drill string torque is at a minimum, and said selected relationship is $$\min\frac{dT_{ds}}{dt} = -k_2 A_{cf} \Omega_{nom}.$$

5. The method of claim 2, wherein the parameter $A_{cf}$ is selected to be $1.0 \leqq A_{cf} \leqq 1.2$.

6. The method of claim 1, wherein the rotational drive system includes a rotary table and a motor driving the rotary table, and wherein the time derivative of the drill string torque is determined from the equation of motion of the drive system $$J_3 \frac{d\Omega_r}{dt} = T_r - T_{ds};$$

wherein $J_3$ is the moment of inertia the rotational drive system, $\Omega_r$ is the rotating speed of the rotary table, $T_r$ is the torque delivered by the motor to the rotary table, and $T_{ds}$ is the drill string torque.

7. The method of claim 6, wherein the motor is an electric motor and wherein $T_r$ rand $\Omega_r$ are determined from the current and voltage supplied to the electric motor.

8. The method of claim 1, further comprising the step of determining the rotational moment of inertia of the BHA from the rotational stiffness of the drill string, and from the relationship $J_1 = k_2 \omega_0^2$; wherein $J_1$ is the rotational moment of inertia of the BHA, $K_2$ is the drill string stiffness, and $\omega_0$ is the frequency of the drill string oscillation.

9. A system for determining the rotational stiffness of a drill string for drilling of a borehole in an earth formation, the drill string having a bottom hole assembly (BHA) and an upper end driven by a rotational drive system, the system comprising:

means for determining the time derivative of the drill string torque during drilling of the borehole at a selected time when stick-slip of the BHA occurs;

means for determining the nominal rotational speed of the drill string at an upper end part thereof at said selected time; and means for determining the rotational stiffness of the drill string from a selected relationship between said time derivative of the drill string torque and said nominal rotational speed.

* * * * *